US006114959A

United States Patent [19]

Bennett

[11] Patent Number: 6,114,959

[45] Date of Patent: Sep. 5, 2000

[54] AUTOMATIC REMOTE MAIL ALERT SYSTEM

[76] Inventor: Ronald J. Bennett, 213 Moonlight Bay Dr., Panama City Beach, Fla. 32407

[21] Appl. No.: 09/253,366

[22] Filed: Feb. 22, 1999

[51] Int. Cl.[7] ..... G08B 13/14

[52] U.S. Cl. ..... 340/569; 200/85 R; 340/539; 340/666

[58] Field of Search ..... 340/569, 666, 340/539; 335/205, 207; 200/85 R

[56] References Cited

U.S. PATENT DOCUMENTS

| | | | |
|---|---|---|---|
| D. 335,747 | 5/1993 | Dearing | D99/29 |
| 2,465,935 | 3/1949 | Scalia | 340/569 |
| 2,469,558 | 5/1949 | Jaskala | 340/569 X |
| 2,535,607 | 12/1950 | Smith | 340/569 X |
| 4,101,877 | 7/1978 | Rush | 340/569 |
| 4,363,439 | 12/1982 | Manian | 232/35 |
| 4,495,388 | 1/1985 | Yoder | 200/61.21 |
| 4,651,135 | 3/1987 | Duhaime et al. | 340/569 |
| 4,868,543 | 9/1989 | Binkley | 340/569 |
| 4,999,612 | 3/1991 | Cherveny | 340/569 |
| 5,023,595 | 6/1991 | Bennett | 340/569 |
| 5,159,316 | 10/1992 | Lazzara | 340/666 X |
| 5,255,843 | 10/1993 | Deakyne | 232/35 |
| 5,382,945 | 1/1995 | Novak | 340/569 |
| 5,664,728 | 9/1997 | Jones | 232/36 |
| 5,950,919 | 9/1999 | Adams | 340/569 X |
| 5,979,751 | 11/1999 | Maddox | 340/569 X |

*Primary Examiner*—Thomas Mullen
*Attorney, Agent, or Firm*—William B. Noll

[57] ABSTRACT

A remote mailbox alerting system for advising users of the system to the delivery of mail to a mail receptacle containing the system. The system includes a floating mail sensing assembly utilizing a pair of opposing, parallel, nonaligned doughnut like magnets, and a radio frequency transmitter in electrical communication therewith. At a remote location, such as the dwelling, a receiver is provided for receiving transmitted signals upon activation of the mail sensing assembly and transmitter. To alert the user, an alarm system is included.

9 Claims, 2 Drawing Sheets

AUTOMATIC REMOTE MAIL ALERT SYSTEM

FIELD OF THE INVENTION

This invention is directed to the field of mail alerting systems for residential and commercial uses, to advise users thereof at a remote location that mail has been delivered to one's mailbox.

BACKGROUND OF THE INVENTION

The present invention relates to an effective, yet low cost remote system for alerting a user of the system to the delivery of mail to a specified mail receptacle, such as a mail box. The system has particular utility to apartment, condo dwellers, or to any user where the mailbox is centralized for a shared group of users, or is quite remote from the residence. The mail sensing mechanism is sufficiently sensitive to even a postcard, the lightest of delivered mail.

The prior art offers various remote detection systems, as reflected in the following U.S. Patents, but none offer the simplicity, effectiveness, and low cost of this invention:

a.) U.S. Pat. No. 5,664,728, to Jones, teaches an automatic signal attachment for a security mail box which indicates when the mail box door is opened by activating an alarm. A magnetic release on the door and a pivoting platform within the mailbox triggers the alarm. The mail box allows users access from within a secured location and indicates delivery of the mail at a remote location.

b.) U.S. Pat. No. 5,382,945, to Novak, is directed to an alarm apparatus that immediately alerts mail recipients of postal deliveries made through a mail slot opening. The device is mounted adjacent the mail slot and has an activation lever, the distal end of which is in contact with the hinged, swinging door of the mail slot, and the proximal end of which has a contact switch retention means. As the door is opened, the activation lever rotates causing the retention means to release the contact switch resulting in the completion of a circuit and the sounding of an alarm.

c.) U.S. Pat. No. 5,255,843, to Deakyne, relates to an alarm housing mounted to an exterior side wall surface of an associated rural or house mounted mailbox. The system includes a switch arm having a roller cylinder mounted at a distal end thereof in engagement with the door portion of a rural mailbox, whereupon pivoting of the rural mailbox door to an opened orientation displaces the roller effecting closure of a switch within the alarm housing to activate visual and audible alarm structure.

d.) U.S. Pat. No. 5,023,595, to Bennett, teaches a remote solar powered radio frequency transmitter assembly and radio receiving and signaling system to indicate delivery of mail. The transmitter means is powered by a rechargeable battery system which is normally recharged by solar cells located on the transmitter means housing. The transmitter means comprises an FM radio transmitter operating in the 49 Mhz band, with a signal strength sufficient for providing an alarm signal to be received at least 4,200 feet distant over unbroken terrain. Upon opening of the mailbox door approximately 30 degrees, a switch initiates a six (6) second operation of the transmitter means. A receiver is provided to detect the radiated signal, and to energize visual and audible signals in response thereto. Ten position DIP switches are provided at both transmitter means and receiver to vary the frequency of operation so as to minimize or eliminate interfering signals. The transmitter means is secured to the mailbox by a single attachment post. A jack plug and flexible cord are provided to connect the transmitter means and the switch. The switch is provided with a flat backing plate having a double sided adhesive for ease of installation. The audible alarm at the receiver comprises a digitally generated musical tune.

e.) U.S. Pat. No. 4,999,612, to Cherveny, relates to a wired mail delivery indicator having a physical construction which forces any size of mail across a groove. Slope on the left vertical wall of mailbox slope of panel, and force of gravity cause mail to block a light beam. The light beam is generated by a photodiode emitter and detected by a photo detector. Mailbox and electronic circuitry contains photodiode emitter, photo detector, current limiting resistor and current amplifier transitors House and electronic circuitry contains power transformer, diode rectifier, and current sensor. House/mailbox connecting wire carries power and mail delivery information with two wires.

f) U.S. Pat. No. 4,363,439, to Manian, is directed to a mail delivery signal device for detached, rural-type mailboxes wherein an elongated signal arm member, swingably secured along its lower end to a lower front portion of the mailbox so as to lean abuttingly there-against at its upper end, falls arcuately downwardly to project beyond the bottom or either side of the mailbox, selectively, upon the door being opened for the delivery of mail, thereby automatically notifying the recipient that mail has been delivered.

g.) U.S. Pat. No. 4,868,543, to Binkley, teaches a remote mailbox alarm system comprising a mailbox unit and a house module. The mailbox unit comprises a position-sensitive door switch which activates timer circuit, a mail sensing circuit, and a transmitter located on an insert board insertable inside the mailbox. When activated, the mail sensing circuit energizes a light-emittng diode to emit infrared light waves that reflect off mail placed inside the mailbox and onto phototransistor which thereby causes the transmitter switch to energize. When the door switch is opened, the timer circuit allows the transmitter to continue transmitting for a predetermined period of time. Signals from the transmitter are received by receiver circuit which activates a speaker and a lamp. When the timer circuit times out, the speaker is deactivated while the lamp continues lit until energized by the pushing of reset switch.

h.) U.S. Pat. No. 4,101,877, to Rush, is directed to a system for activating a light and music box in the home when mail is deposited in a mail box located outside the home, and for deactivating the light and music box when the mail is removed. Switch means is provided inside the mail box and a circuit is arranged to activate the signal devices every other time the switch means is closed. Additionally, a signal light is provided on the mail box to enable a visitor to find the proper home at night, and an electrically operated lock is provided for the mail box to prevent the mail from being stolen.

i.) U.S. Pat. No. D-335,747, to Dearing et al., is a design patent illustrating a mail delivery indicator and holder.

The above prior art describes and illusrates various complex systems for sending an alarm or notice to a user of the mailbox that mail has been delivered to the mailbox. The present invention offers a simpler, yet more effective approach to alert such users. The manner by which this approach is realized will become apparent from a reading of the following specification, particularly when read in conjunction with the accompanying drawings.

SUMMARY OF THE INVENTION

The present invention is directed to a remote mailbox alerting system to advise a user to the delivery of mail to the user's mailbox. The system comprises a mail sensing means disposed within the mailbox and operable by the weight of mail positioned thereon. The sensing means comprises upper and lower spaced apart planar housing members generally aligned in a parallel relationship, where each housing member mounts a centrally positioned doughnut magnet. The respective polarities of the magnets are rotatively misaligned to maintain the housings members spaced during nonuse. By way of clarification, with reference to a clock face, if the polar settings of the upper magnet are as follows:

N–12 o'clock

S–3 o'clock

N–6 o'clock

S–9 o'clock, then the polar settings of the lower magnet may be as follows:

N–2 o'clock

S–5 o'clock

N–8 o'clock

S–11 o'clock

It will be understood that so long as the respective N-S polarities are not vertically aligned, there is the natural repulsive force separating the magnets. The degree of repulsion can be varied by rotating one magnet relative to the other.

Returning to the sensing means of this invention, there is included at least a pair of vertically aligned electrical contacts, whereupon movement of the upper housing toward the lower housing will bring the contacts into electrical engagement, and a radio frequency transmitter in electrical communication with the contacts. Further, a remote radio frequency receiver is provided to be responsive to transmitted signals from the transmitter. Finally, an alarm means is included in electrical communication with a DIP switch, whereby the receiver, upon receipt of a transmitted signal, activates the DIP switch, which in turn activates the alarm means to alert the user thereof to the delivery of mail to the remote mailbox.

Accordingly, an object of this invention is to provide an effective, low cost system to alert users thereof to the delivery of mail to the user's mail receptacle, such as a mailbox.

Another object hereof is the provision of a portable, weight responsive device that is disposed within the mailbox, where the weight of the mail placed thereon, even a post card, is sufficient to trigger an alerting alarm signal.

A further object of this invention lies in the use of a pair of floating, doughnut like magnets spatially fixed relative to one another during periods of nonuse.

These and other objects of the invention will become more apparent to those skilled in the art from the description which follows.

DETAILED DESCRIPTION OF PREFERRED EMBODIMENT

Figure 1:
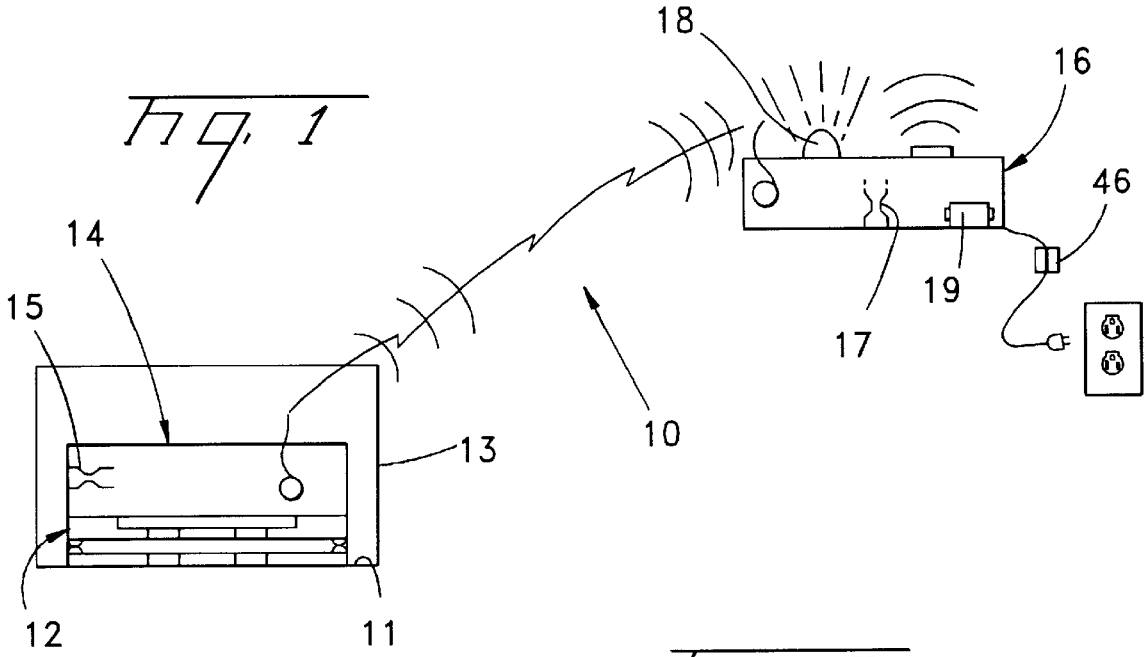
FIG. 1 is a schematic representation of the system of this invention illustrating the several components and their interrelationship to form the remote mail alerting system hereof.

This invention relates to an automatic, remote mail alerting system to allow users, at a distance from their mail receptacle, to know precisely when mail has been delivered to the mail receptacle. The invention will now be described with reference to the several Figures, where like reference numerals represent like components or features throughout the various views.

Turning first to FIG. 1, which illustrates schematically the system 10 of this invention, the system 10 comprises a floating mail detecting assembly 12 to be disposed along the floor 11 of a mail receptacle 13, such as a mailbox, where the assembly 12 is activated by the weight of mail placed thereon, even by the minimal weight of a postcard. The arrangement and operation of the assembly will be explained in greater detail hereafter. In electrical communication with the floating assembly 12 is a radio frequency transmitter 14, preferably secured to the assembly 12, which as noted above is positioned on the floor 11 of a mail receptacle 13, a radio frequency receiver 16 for receiving signals from the transmitter 14, when activated. The receiver 16 would typically be positioned for the convenience of the user remote from the mail receptacle, such as in the home, apartment, condo, etc. In order to alert the user to the delivery of mail to the selected mail receptacle, an alarm system 18, in electrical communication with the receiver 16, is provided.

Figures 2, 5, 6, 7:
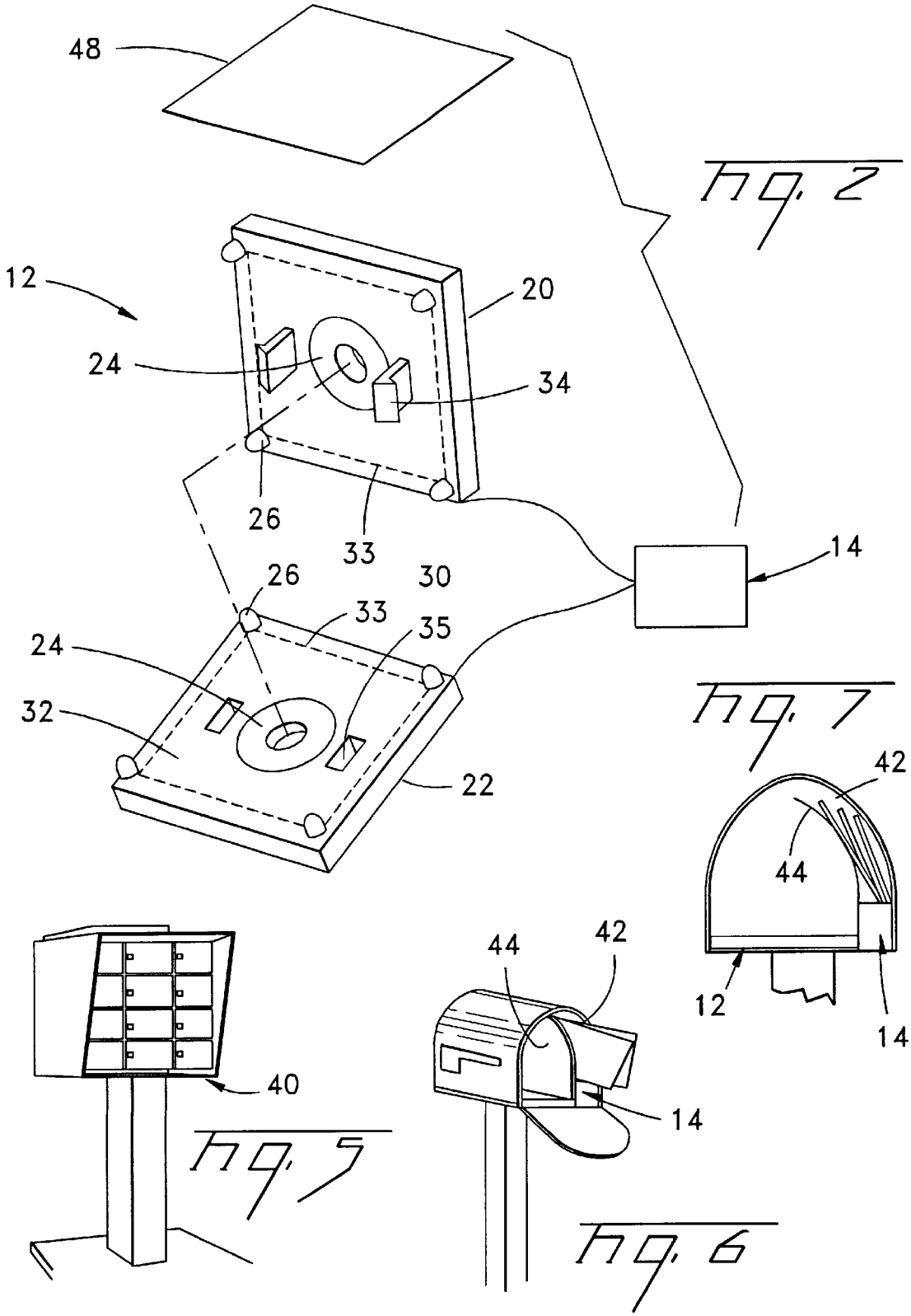
FIG. 2 is an exploded perspective view of a pair of floating housing members, each preferably containing a doughnut like magnet, where such housing members cooperate to form the mail detecting mechanism of this invention, showing further its relationship to a radio frequency transmitter.
FIG. 5 is a perspective view of a multiple type mail receptacle in which the system of this invention may be used, where such multiple mail receptacle may be found in an apartment or condo complex.
FIG. 6 is a perspective view of a single rural type mail receptacle, showing further an off-set outgoing mail slot.
FIG. 7 is a front view of the rural type mail receptacle of FIG. 6, showing a flexible divider to separate outgoing mail from the mail receiving housing members.

Returning now to the details of the several components, FIG. 2 illustrates details of the floating mail detecting assembly 12. The mail detecting assembly 12 comprises upper and lower, generally rectangular housing members 20, 22, respectively, within each is mounted a doughnut like magnet 24. Further, each said housing member may include plural electrical contacts 26, preferably at the respective corners, where a given contact 26 is raised along the opposing faces 30, 32, respectively, and vertically aligned with a given contact in the other housing member. Additionally, as will be apparent hereafter, the contacts 26 within a housing member are in electrical communication via conductors 33 with one another. Alternately, the contacts of a given housing may consist of a continuous conductive wire arced along the faces 30, 32, such that the relative movement of the housing members toward one another will bring opposing arcuate sections into electrical contact. This will become clearer in the description to follow.

Figure 3:
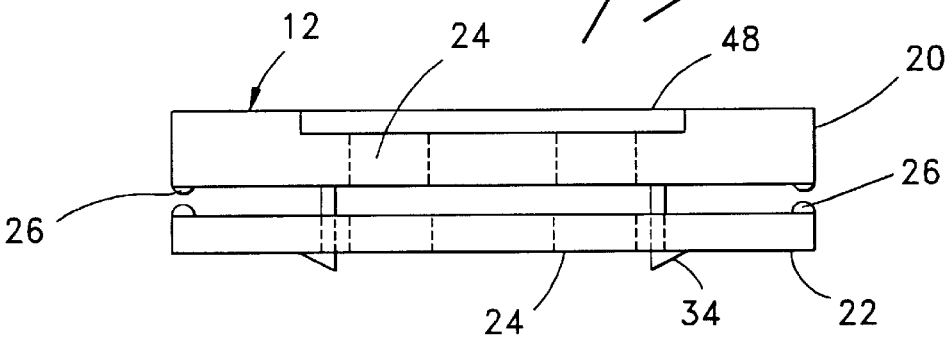
FIG. 3 is a sectional view, taken through the assembled housing members of FIG. 2, showing the spatial relationship of the respective housing members during a period of nonuse.

While the upper and lower housing members 20, 22 are in floating relationship to one another, they are held in a spatial relationship by a pair of flexible latching arms 34 extending from the upper housing member face 30 through appropriate apertures 35 in the lower housing member 22, see FIG. 3. This relationship illustrates the maximum separating distance, and the position of nonuse for the assembly 12.

Figure 4:
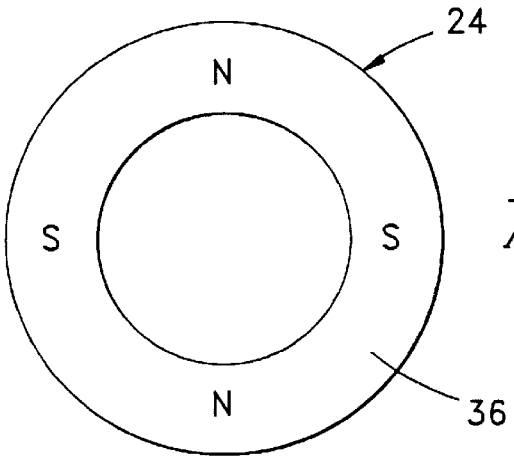
FIG. 4 is a top plan view of a typical doughnut like magnet for inclusion in the respective housing members of FIGS. 2 and 3.

A significant feature of the mail detecting assembly 12, and the means to facilitate their relative movement toward one another, under the weight of mail placed on the upper housing member 20, is the presence of magnets centrally disposed within the housing members 20, 22. In a preferred embodiment, the magnets 24 are doughnut shaped or continuous, and made of a nonconductive ceramic material. However, the magnets may be formed of metal, such as compressed powdered metals, or as arcuate segments. In any case, the ceramic "ring" typically is magnetized along the face 36 (FIG. 4) with a pair of opposing N-polarities, and a pair of opposing S-polarities transverse thereto. Simulated to the face of a clock, the N-polarity would be at '12' and '6' o'clock, and the S-polarity at '3' and '9' o'clock. It will be appreciated that when an N-polarity of each magnet 24 overlies one another, i.e. both at '12' o'clock, this situation represents the greatest repulsive force between the respective magnets. However, if one magnet is rotated 90 degrees, the greatest attraction force is achieved. Thus, with a relative rotation of less than 90 degrees, one begins to decrease the repulsive force accordingly, such that at some point a minimized force is achieved, whereby a slight pressure, such as the weight of a postcard, will cause the two magnets 24 to initiate a closure. This limited pressure or weight is sufficient to move or tilt the upper housing member 20 toward the lower housing member 22, thus bringing at least a pair of opposing contacts 26 into electrical engagement to complete an electrical circuit.

FIG. 5 illustrates a typical, centralized, multiple mail receptacle 40 that may be found at an apartment or condo complex. Since individual mailboxes are in close proximity to other such mailboxes, the system 10 hereof preferably incorporates multi position DIP switches, 15, 17, respectively, as known in the art, at the transmitter 14 and receiver 16 to allow varying the frequency of operation to eliminate interferring signals from a comparable mail detecting system in an adjacent mailbox.

FIGS. 6 and 7 show an option available to rural users of the system 10. In remote rural areas, it is not unusual for people to place outgoing mail in a mailbox to be picked up at the time of mail delivery by the postal carrier. However, to avoid the problem of prematurely triggering the system 10, an outgoing mail slot 42 may be provided. This is best illustrated in FIG. 7. To define the slot 42, a flexible barrier 44, such as in the form of a plastic film, may be provided. That is, the outgoing mail may be placed on the radio frequency transmitter 14, for example, and separated from the mail detecting assembly 12 by the barrier 44.

The receiver 14 may incorporate an alarm means, such as a visual or audio alarm as known in the art, or the alarm means may be separate to be triggered by the DIP switches 15 within the receiver 14. Additionally, the receiver may include a portable power source, i.e. battery 19, with an optional back-up power source, namely the house current. With the system 10 positioned on the floor of a mail receptacle, when the postal carrier inserts mail into the mailbox, the upper housing member 20, under the weight of the delivered mail, tilts or moves downward and makes contact with the lower housing member 22 activating a DC current flow to the DIP switches which sends a unique radio frequency to the radio receiver 16 through a built-in antenna, thus activating the DC switch in the apartment, condo or residence converting that DC signal to AC current supplied by the dwelling and activating at least one of the alarm means. Further, a master ON/OFF switch 46 may be provided in the AC line prior to the alarm means 18 to deactivate the alarm means, as desired. Finally, as a security measure, a lead shield 48, recessed within the upper housing member 20 over the magnet 24, may be provided to protect magnetically sensitive mail, see FIGS. 2 and 3.

While the invention has been described relative to a preferred embodiment, it is recognized that variations, modifications, and changes may be made therein without departing from the spirit and scope of the invention. Accordingly, no limitation is intended to be imposed thereon except as set forth in the following claims.

What is claimed is:

1. A remote mailbox alerting system to advise a user to the delivery of mail to the user's mailbox, said system comprising:

a.) a mail sensing means disposed within the mailbox and operable by the weight of mail positioned thereon, said sensing means comprising:

(i.) upper and lower spaced apart planar housing members generally aligned in a parallel relationship, each said housing mounting a centrally positioned doughnut magnet, where the respective polarities of said magnets are rotatively misaligned to maintain said housings spaced during nonuse, (ii.) at least a pair of vertically aligned electrical contacts, whereupon movement of the upper housing toward the lower housing will bring said contacts into electrical engagement, and (iii.) a radio frequency transmitter in electrical communication with said contacts, b.) a remote radio frequency receiver, responsive to transmitted signals from said transmitter, having a DIP switch; and, c.) an alarm means in electrical communication with said DIP switch, whereby said receiver, upon receipt of said transmitted signal, activates said DIP switch which in turn activates said alarm to alert the user thereof to the delivery of mail to said mailbox.

2. The remote mailbox alerting system according to claim 1, wherein said upper housing includes a planar lead shield overlying the doughnut magnet mounted therein to protect magnetically sensitive mail that may be deposited in the mailbox.

3. The remote mailbox alerting system according to claim 1, wherein said housing members are rectangular in configuration with a said electrical contact at each respective corner thereof.

4. The remote mailbox alerting system according to claim 1, wherein said DIP switch has a primary and a secondary electrical power source.

5. The remote mailbox alerting system according to claim 4, wherein the electrical communication between said alarm means and said DIP switch includes a manually activated ON/OFF switch.

6. The remote mailbox alerting system according to claim 1, wherein said radio frequency transmitter includes a DIP switch to provide security thereto and eliminate interfering signals.

7. The remote mailbox alerting system according to claim 1, wherein the spatial relationship of said upper and lower housing members, in a nonuse condition, is maintained by cooperative latching members.

8. The remote mailbox alerting system according to claim 7, wherein said upper housing member includes a pair of flexible arms, and said lower housing member includes aligned apertures for receiving a corresponding said flexible arm.

9. The remote mailbox alerting system according to claim 1, m combination with a rural mailbox, wherein a separate slot for outgoing mail is provided within said mailbox free of said mail alerting assembly.

* * * * *